US011910858B2

(12) United States Patent
Gotti

(10) Patent No.: US 11,910,858 B2
(45) **Date of Patent: *Feb. 27, 2024**

(54) HELMET

(71) Applicant: KASK S.P.A., Chiuduno (IT)

(72) Inventor: Angelo Gotti, Nembro (IT)

(73) Assignee: KASK S.P.A., Chiuduno (IT)

( * ) Notice: Subject to any disclaimer, the term of this patent is extended or adjusted under 35 U.S.C. 154(b) by 192 days.

This patent is subject to a terminal disclaimer.

(21) Appl. No.: 17/086,867

(22) Filed: Nov. 2, 2020

(65) Prior Publication Data

US 2021/0127775 A1 May 6, 2021

(30) Foreign Application Priority Data

Nov. 5, 2019 (IT) ..... 102019000020410

(51) Int. Cl.
*A42B 3/06* (2006.01)

(52) U.S. Cl.
CPC ..... *A42B 3/062* (2013.01)

(58) Field of Classification Search
CPC .. A42B 3/10; A42B 3/12; A42B 3/127; A42B 3/062; A42B 3/063; A42B 3/06; A42B 3/128; A63B 71/10
See application file for complete search history.

(56) References Cited

U.S. PATENT DOCUMENTS 6,279,172 B1 * 8/2001 Epperson ..... A42B 3/12 2/418
9,420,842 B2 * 8/2016 Witcher ..... A42B 3/121
10,226,094 B2 * 3/2019 Straus ..... A42B 3/064
10,398,187 B1 9/2019 Shaffer
(Continued)

FOREIGN PATENT DOCUMENTS

DE 299 17 109 U1 1/2000
DE 20 2013 102 870 U1 7/2013
(Continued)

OTHER PUBLICATIONS

Italian Search Report dated Jul. 2, 2020 in Italian Application 102019000020410 filed Nov. 5, 2019 (with English Translation of Categories of Cited Documents), citing documents AA-AB and AO-AR therein, 3 pages.

*Primary Examiner* — Katherine M Moran
(74) *Attorney, Agent, or Firm* — Oblon, McClelland, Maier & Neustadt, L.L.P.

(57) ABSTRACT

A helmet for work or sports, including a structure having a substantially convex outer surface and a substantially concave inner surface; a protective body of polystyrene, having a first portion engageable to the inner surface and a second portion having a concavity for receiving the head of a user. The protective body includes: a base element made up of a first material for shock and/or impacts absorption having a predetermined first density value, the base element having a concave surface defining the concavity and a housing cavity facing away with respect to the concave surface; a protective insert made of a second material for shock and/or impact absorption having a second predetermined different density value, preferably lower, than the first density value of the first material, the protective insert being at least partially insertable in the housing cavity.

13 Claims, 5 Drawing Sheets

(56) References Cited

U.S. PATENT DOCUMENTS

| | | | | |
|---|---|---|---|---|
| 2004/0025229 | A1* | 2/2004 | Takahashi | A42B 3/128 2/412 |
| 2015/0272257 | A1* | 10/2015 | Pritz | A42B 3/127 2/414 |
| 2020/0085131 | A1* | 3/2020 | Saijo | A42B 3/064 |
| 2021/0127776 | A1* | 5/2021 | Gotti | A42B 3/12 |

FOREIGN PATENT DOCUMENTS

| | | | |
|---|---|---|---|
| EP | 1 388 300 | A2 | 2/2004 |
| EP | 1 388 300 | A3 | 2/2004 |
| WO | WO 2018/231632 | A1 | 12/2018 |

* cited by examiner

HELMET

BACKGROUND OF THE INVENTION

Field of the Invention

The present invention relates to a helmet, particularly protective helmet for work or sports.

The object of the present invention belongs to the field of helmets, headpieces and/or similar safety protective headgears which can be used during the performing of dangerous and risky activities, such as those carried out in construction sites, mines, oil platforms, by fire-fighters, by first aid providers, by mountain climbers or those carried out in any field where it is necessary to protect the head of the users. The object of the present invention is also suitable to be applied in the field of sports helmets, such as for example those intended for cycling, horse riding, skiing and for any other sports activity requiring the use of helmets.

Description of the Related Art

As known, protective helmets for work generally comprise a structure having at least one convex outer surface and at least one concave inner surface adapted to receive in engagement the head of a user.

The inner surface of the helmet structure is usually equipped with a protective body made of a material suitable for shock and impacts absorption, such as polystyrene.

Generally, the protective bodies of the aforementioned helmets are made by moulding in a single polystyrene monobloc which has a predetermined density on all parts of the protective body.

Although helmets equipped with monobloc protective bodies made of a material having a relative density are widely used, the Applicant has found that they are not free from some drawbacks and can be improved in various respects, mainly in relation to the shock and impacts absorption capacity at differentiated areas of the helmet, to the practicality and ease of assembly and disassembly of the protective body with respect to the structure of the helmet, as well as to the adjustment of the positions of the protective body with respect to the structure of the helmet.

BRIEF SUMMARY OF THE INVENTION

The main object of the present invention is to propose a helmet capable of absorbing in a different way the shocks and impacts to which they are subjected.

It is an object of the present invention to make the protective body easy and simple to clean.

It is also an object of the present invention to increase the resistance of the protective body to lateral crushing, scratches and surface abrasions.

It is a further object of the present invention to propose a helmet which allows the assembly and disassembly of the protective body with respect to the structure in an easy, practical and rapid way.

It is also an object of the present invention to propose a helmet that allows a simple and easy adjustment of the positions, in particular in height, of the protective body with respect to the structure of the helmet.

The above specified and yet further objects are substantially achieved by a helmet, particularly protective helmet for work or sports, as stated and described in the following claims.

There is now provided, by way of example, the description of a preferred but not exclusive embodiment of a helmet, particularly protective helmet for work or sports.

BRIEF DESCRIPTION OF THE SEVERAL VIEWS OF THE DRAWINGS

Such description will be made herein below with reference to the accompanying drawings, provided for indicative purposes only and therefore not limiting, wherein.

DETAILED DESCRIPTION OF THE INVENTION

Figure 1:
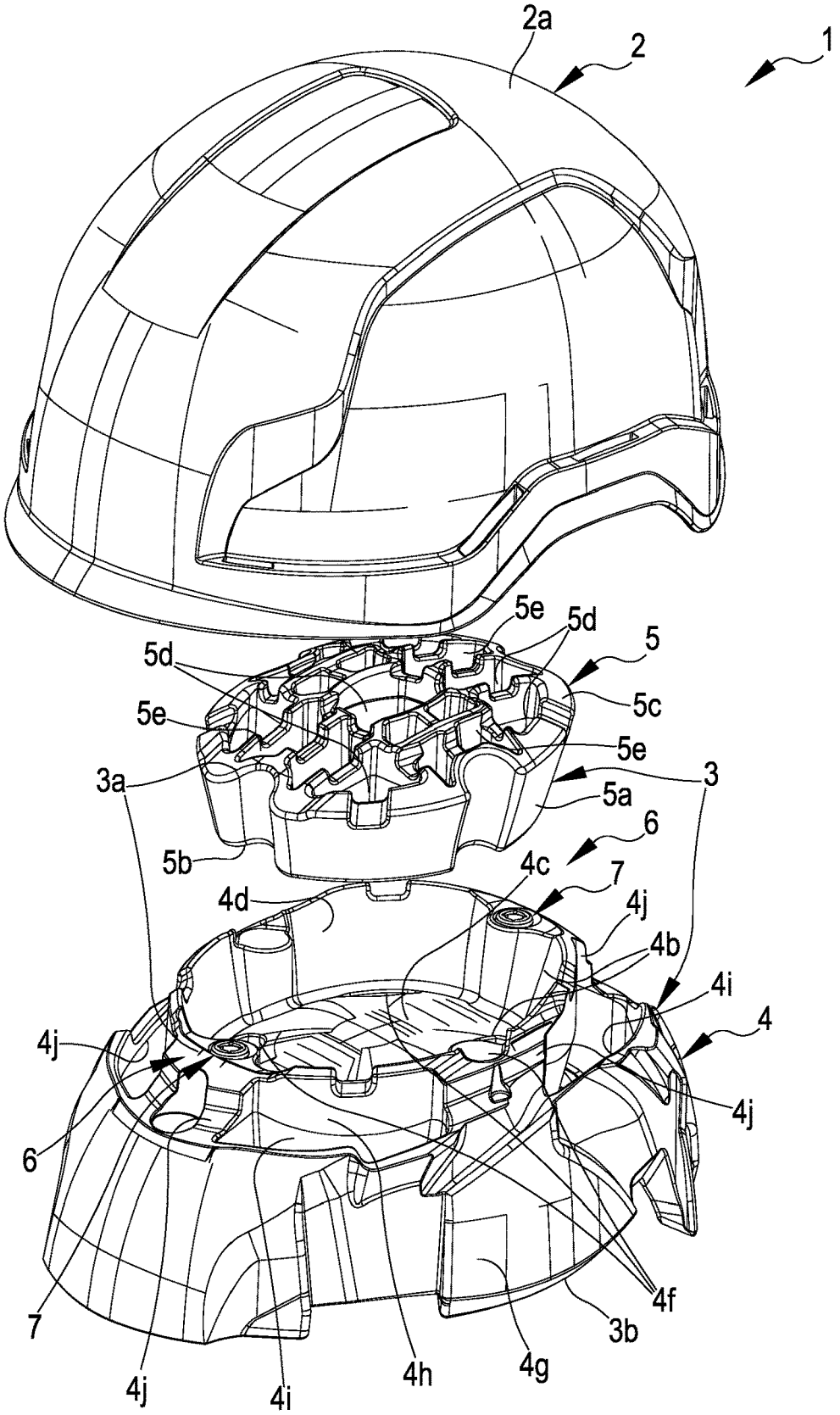
FIG. 1 is an exploded perspective view of a helmet, particularly protective helmet for work, in accordance with the present invention.
Figure 2:
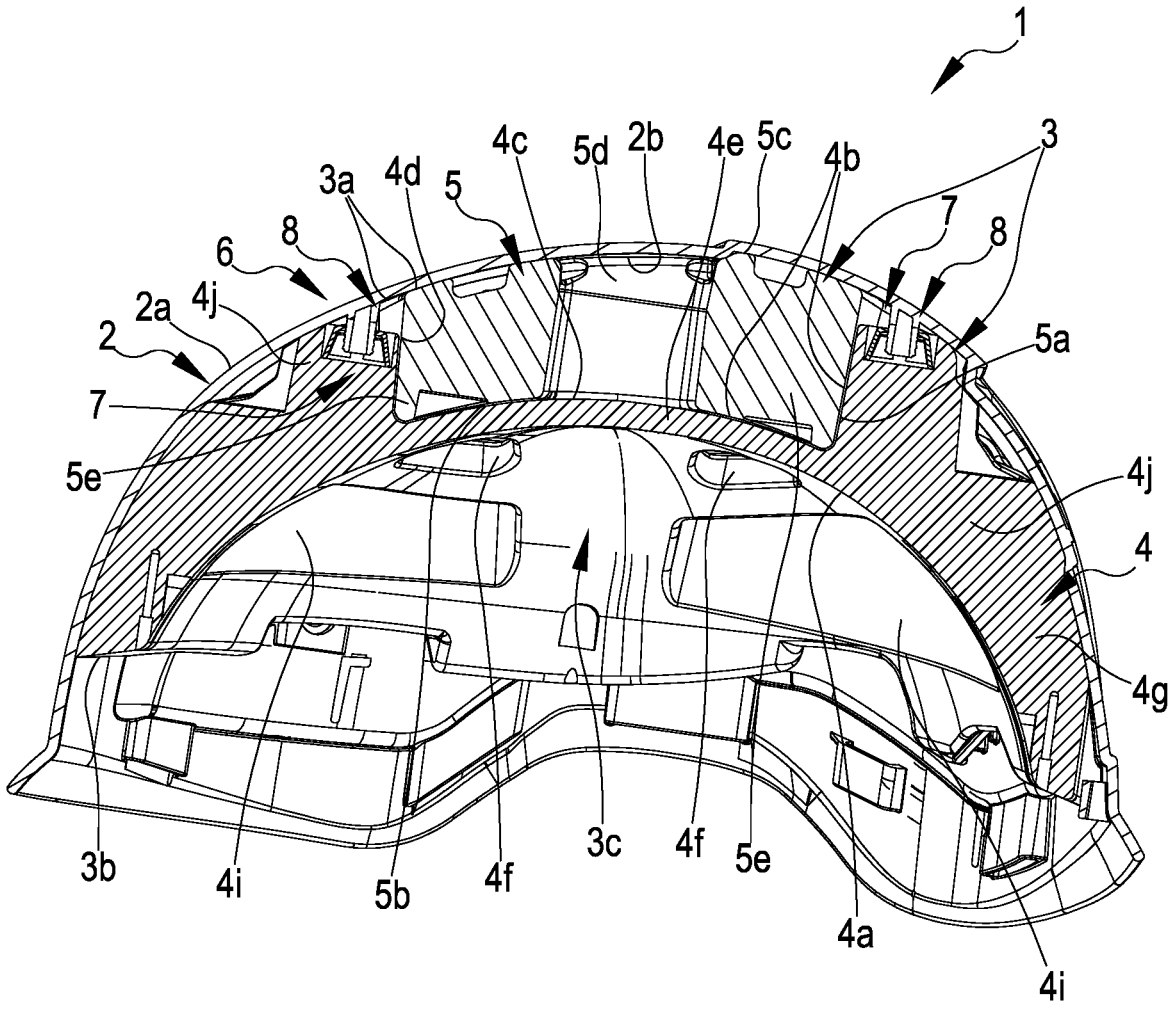
FIG. 2 is a longitudinal section of the helmet of FIG. 1.

With reference to FIGS. 1 to 2, number 1 generally indicates a helmet, particularly protective helmet for work or sports, according to the present invention.

As visible in FIGS. 1 and 2, the helmet 1 comprises a structure 2 having at least one convex outer surface 2*a* and at least one concave inner surface 2*b* (FIG. 2) adapted to receive in engagement the head of a user.

The helmet 1 further comprises at least one protective body 3 (FIGS. 1 to 4) made of a material capable of absorbing shocks and impacts, preferably polystyrene.

The protective body 3 has a first portion 3*a* engageable to the inner surface 2*b* of the structure 2 and at least a second portion 3*b* having at least one concavity 3*c* (FIGS. 2 and 3) adapted to receive in engagement the head of a user.

Advantageously, the protective body 3 comprises a base element 4 made up of a first material suitable for shock and impacts absorption, preferably polystyrene, having a first predetermined density value D1.

As visible in FIGS. 1 to 4, the base element 4 has a concave surface 4*a* defining the concavity 3*c* of the protective body 3 and at least one housing cavity 4*b* facing away with respect to the concave surface 4*a*.

As visible in FIGS. 1 to 4, the housing cavity 4*b* of the base element 4 is preferably located on the top of the latter.

More and more in detail, the housing cavity 4*b* of the base element 4 is defined by a bottom 4*c* and by at least one side wall 4*d* extending transversely to the bottom 4*c*.

The bottom 4*c* of the housing cavity 4*b* of the base element 4 has a substantially circular or oval shape from the periphery of which the side wall 4*d* extends.

Figure 3:
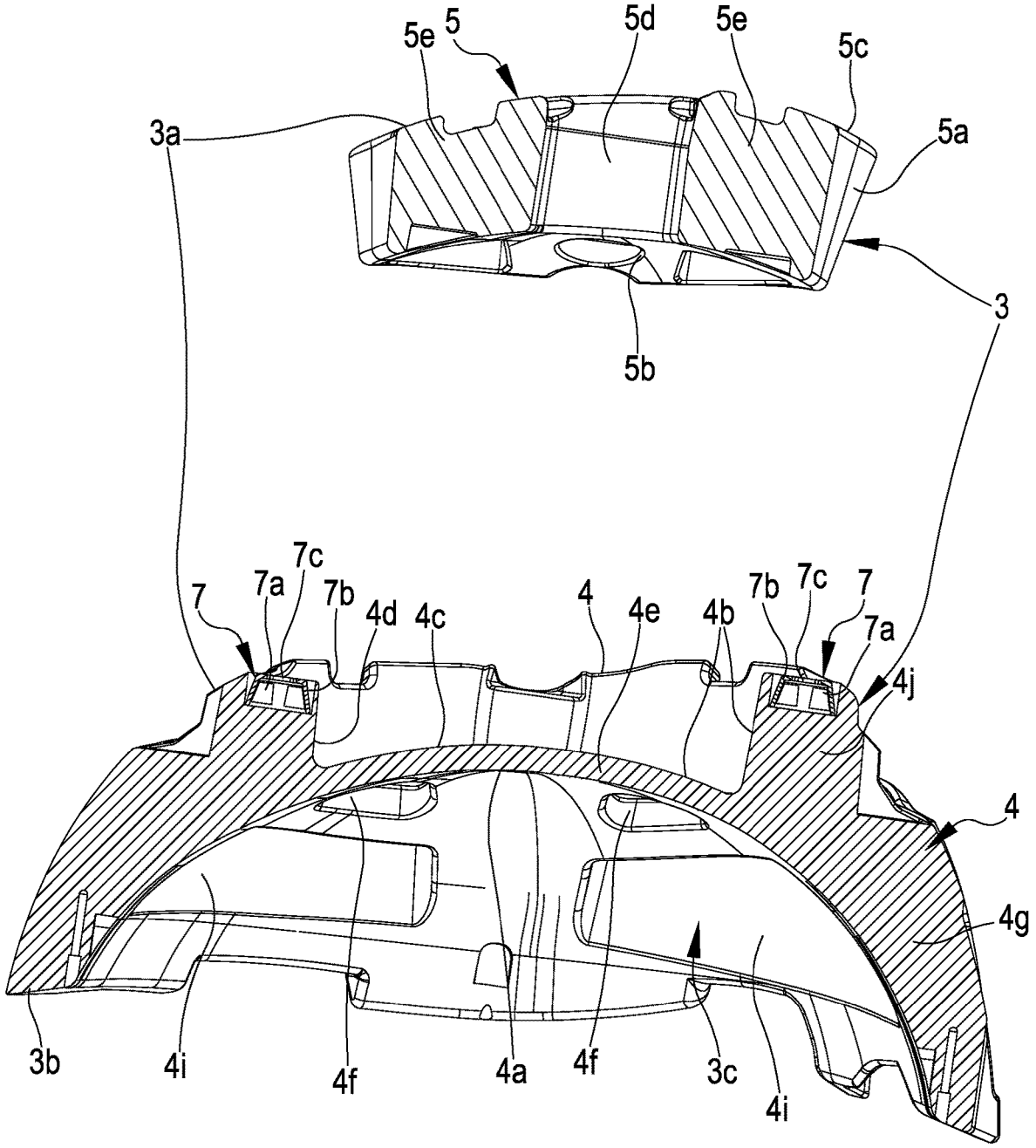
FIG. 3 is an exploded longitudinal section of a protective body of the helmet of FIGS. 1 and 2.
Figure 4:
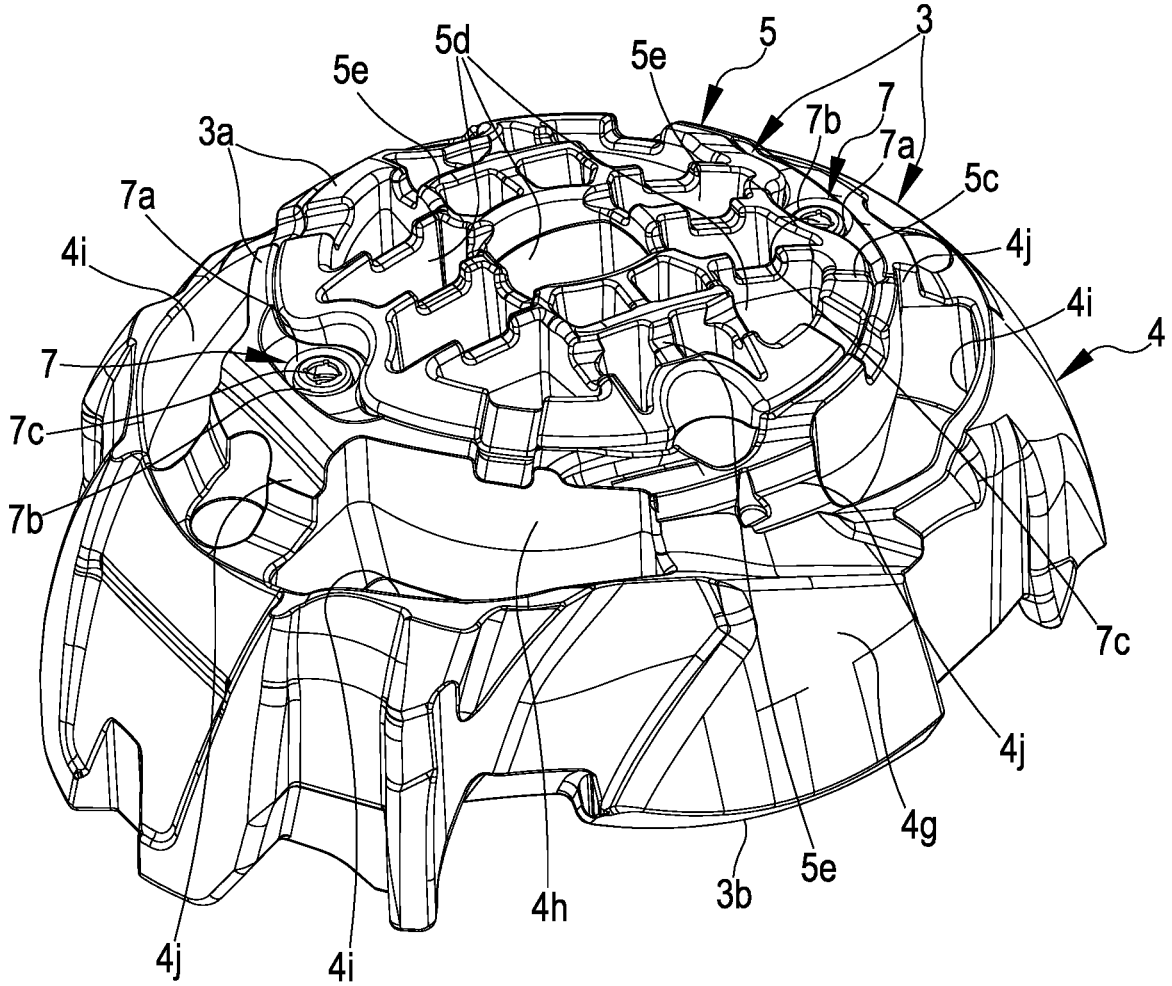
FIG. 4 is a top perspective view of the protective body of FIG. 3.

As visible in the sections shown in FIGS. 2 and 3, the concave surface 4*a* of the base element 4 is spaced from the bottom 4*c* of the respective housing cavity 4*b* by an intermediate thickness 4*e* of the first material with which the base element 4 is made.

With reference to FIG. 1, the housing cavity 4*b* of the base element 4 of the protective body 3 and the concavity 3*c* of the same are in fluid communication by means of a plurality of aeration through openings 4*f* obtained through the thickness of material 4*e*, between the bottom 4*c* of the housing cavity 4*b* and the concave surface 4*a* of the base element 4.

The base element 4 also has at least one outer annular portion 4*g* and at least one inner annular portion 4*h* defining the housing cavity 4*b*.

The outer annular portion 4*g* and the inner annular portion 4*h* are separated by at least one interspace 4*i*, preferably a plurality of interspaces 4*i* arranged to form substantially a ring.

The outer annular portion 4*g* and the inner annular portion 4*h* are connected to each other by at least one junction portion 4*j*, preferably a plurality of junction portions 4*j*, developing radially with respect to the annular portions 4*g*, 4*h*.

Advantageously, the first density value D1 of the first material with which the base element 4 is made is between 70 g/l and 110 g/l.

As visible in FIGS. 1 to 4, the protective body 3 further comprises at least one protective insert 5 which is at least partially insertable in the housing cavity 4*b* of the base element 4.

The protective insert 5 comprises at least a peripheral portion 5*a* at least partially, preferably totally, complementarily shaped to the side wall 4*d* of the housing cavity 4*b* of the base element 4.

The protective insert 5 also comprises at least one base portion 5*b* arranged to rest on or to lie near the bottom 4*c* of the housing cavity 4*b* of the base element 4.

The protective insert 5 is also provided with at least one head portion 5*c* arranged on the opposite side to the base portion 5*b* and arranged to rest against or to lie near the concave inner surface 2*b* of the structure 2 of the helmet 1.

The protective insert 5 of the protective body 3 has a substantially alveolar structure, provided with a plurality of through and/or blind openings 5*d* defined by corresponding partition walls 5*e* oriented transversely each other.

Preferably, the protective insert 5 of the protective body 3 is made of a second material for shock and/or impact absorption, advantageously polystyrene, having a second predetermined different density value D2, preferably lower, than the first density value D1 of the first material of the base element 4 of the protective body 3.

In accordance with an advantageous aspect of the present invention, the density value D2 of the second material with which the protective insert 5 of the protective body 3 is made is between 20 g/l and 40 g/l. With reference to the attached figures and, in particular, to FIG. 2, the helmet 1 comprises at least a coupling mechanism 6 operatively interposed between the structure 2 and the protective body 3 to ensure a removable engagement of the latter with the structure 2.

The coupling mechanism 6 comprises at least one coupling seat 7, preferably made on the protective body and at least one coupling element 8, preferably arranged on the structure 2 of the helmet 1, even more preferably protruding from the inner surface 2*b* of the latter.

The coupling element 8 is arranged to engage the coupling seat 7 in such a way that the protective body 3 can be positioned according to at least two different positions, preferably a plurality of different positions, with respect to the structure 2 of the helmet 1.

In detail, the coupling seat 7 and the coupling element 8 of the coupling mechanism 6 are configured so as to allow adjustment, in height, of the protective body 3 with respect to the structure 2 of the helmet 1.

Figure 5:
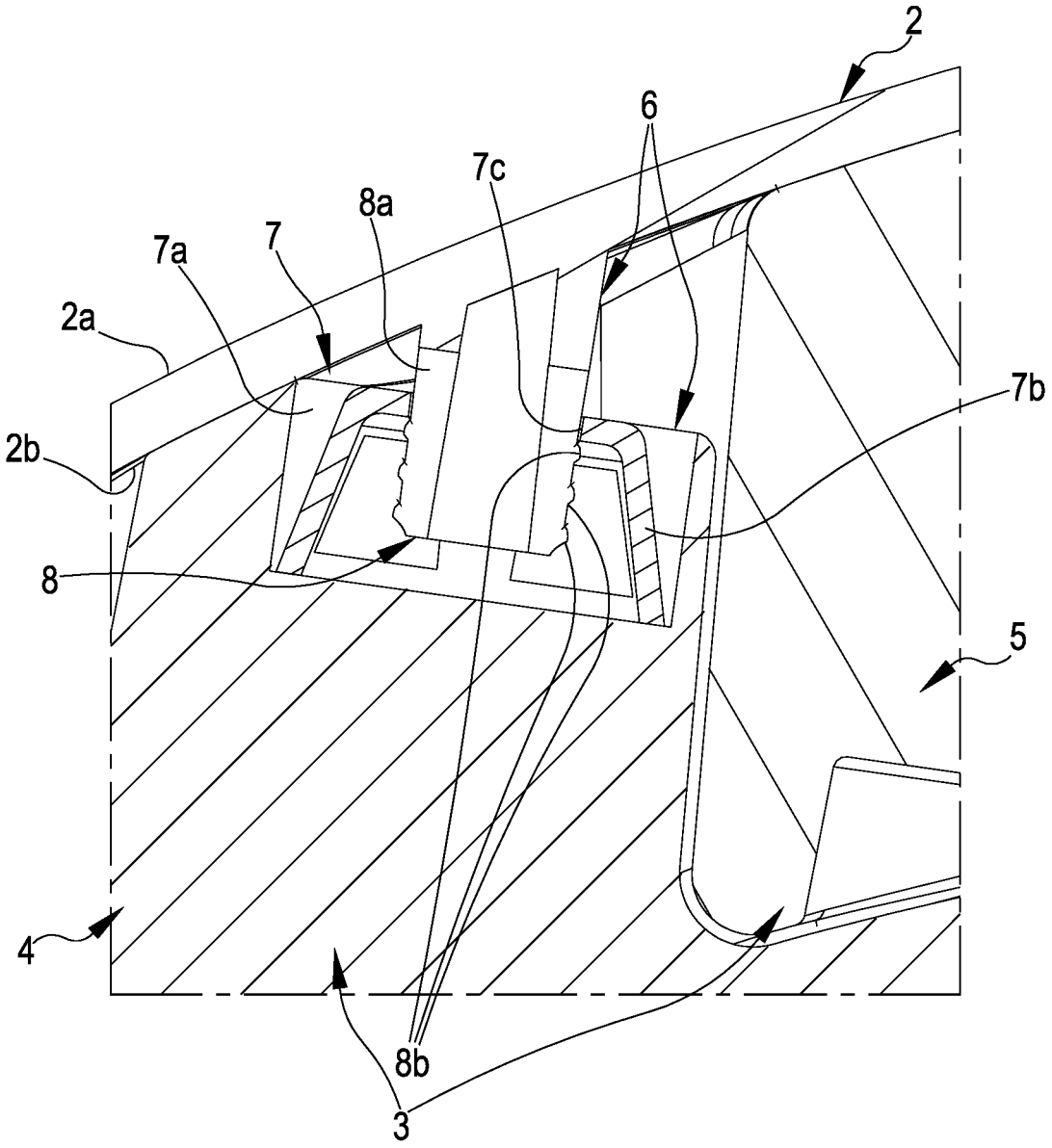
FIG. 5 is an enlargement of a detail of FIG. 2.

As visible in the enlargement of FIG. 5, the coupling seat 7 of the coupling mechanism 6 comprises at least one cavity 7*a* made in the protective body 3 and at least one fixing button 7*b* which can be placed inside the cavity 7*a* of the coupling seat 7, preferably fixable to the cavity 7*a* of the coupling seat 7 in such a way as to remain inside the latter according to a predetermined position.

The fixing button 7*b* has a substantially truncated-cone shaped frame on which at least one latching slot 7*c* (FIGS. 3 and 5) is obtained, preferably at least partly elastically deformable, due to an engagement, preferably by snap or by interference, of the coupling element 8 of the coupling mechanism 6.

Advantageously, the coupling element 8 comprises at least an engagement pin 8*a* provided with two or more surface projections 8*b*.

Each surface projection 8*b* of the engagement pin 8*a* determines a relative position, preferably, in height, between the protective body 3 and the helmet 1 structure 2.

As visible in FIGS. 2, 3 and 5, the cavity 7*a* of the coupling seat 7 is realized on the base element 4 of the protective body 3, preferably on the inner annular portion 4*h* of the base element 4.

The cavity 7*a* of the coupling seat 7 faces toward the same side as the housing cavity 4*h* of the base element 4, i.e. on the opposite side with respect to the concave surface 4*a* of the latter.

As visible in FIGS. 1 to 4, the coupling mechanism 6 comprises at least two coupling seats 7 aligned along a longitudinal axis of the protective body 3, disposed respectively in a front portion and in a rear portion of the latter.

Each coupling seat 7 of the coupling mechanism 6 is formed near the housing cavity 4*b* of the base element 4 of the protective body 3.

The helmet according to the present invention solves the problems observed in the known technique and achieves important advantages.

First of all, the arrangement of a protective body consisting of two distinct mutually engageable components, i.e. the base element and the protective insert, allows the realization of a protective body having structural areas with different densities and, consequently, different behaviours in the event of shocks or impacts.

Advantageously, the arrangement of two distinct components the union of which defines the protective body, allows the base element to be made with a material having a density greater than the density of the materials usually used to form the protective bodies of known helmets, as well as the density of the material used to make the protective insert.

The increase in the density of the material of the base element of the protective body leads to a considerable increase in the resistance of the protective body to lateral crushing.

Furthermore, the increase in the density of the material of the base element of the protective body allows to obtain a more homogeneous and compact component with respect to the bodies obtainable using materials of lower density.

In addition, the increase in the density of the material of the base element considerably facilitates the cleaning operations of the same, since the surfaces of the latter are more rigid and smooth.

It should also be considered that the increase in the density of the material of the base element of the protective body allows a considerable increase in the resistance of the same to atmospheric agents, wear, shocks and impacts, as well as scratches and surface abrasions.

The arrangement of a protective body composed of two distinct components also allows a considerable reduction of the density of the protective insert in order to manage the type of response to any stresses to which the protective body is subjected in the event of a shock or impact in the area responsible for this component.

It should also be considered that the structural configuration of the annular element is such as to incorporate the low-density protective insert in its inside which is therefore protected, on the opposite side with respect to the structure of the helmet, by the high-density base element.

A further advantage of the helmet according to the present invention lies in the excellent stability of the engagement between the protective body and the helmet structure which is ensured by the coupling mechanism.

It should also be noted that the coupling mechanism allows the assembly or disassembly of the protective body on the helmet structure in an easy, simple and rapid way.

Furthermore, the coupling mechanism between the protective body and the helmet structure allows for an easy and effortless adjustment of the height of the protective body, giving the helmet itself greater adaptability to the size of the user's head. Depending on the size of the user's head, the height adjustment of the protective body prevents the structure of the helmet from reducing the visibility of the user wearing the helmet.

The invention claimed is:

1. A protective helmet for work or sports, comprising:

a structure having a substantially convex outer surface and a substantially concave inner surface;

a protective body having a first portion engageable to the inner surface of the structure and a second portion having a concavity adapted to receive in engagement the head of a user;

wherein the protective body comprises:

a base element made up of a first material for shock and/or impact absorption having a predetermined first density value, the base element having a concave surface defining the concavity of the protective body and a housing cavity facing away with respect to the concave surface; and a protective insert made of a second material for shock and/or impact absorption having a second predetermined different density value lower than the first density value of the first material of the base element, the protective insert being at least partially insertable in the housing cavity of the base element, and wherein the housing cavity of the base element is defined by a bottom and by a side wall extending transversely to the bottom, the concave surface of the base element being spaced from the bottom of the respective housing cavity by an intermediate thickness of the first material.

2. The helmet according to claim 1, wherein the base element comprises:

an outer annular portion;

an inner annular portion defining the housing cavity for the protective insert, the outer annular portion and the inner annular portion being separated by an interspace, the outer annular portion and the inner annular portion being connected by a junction portion extending radially, with respect to the outer and inner annular portions.

3. The helmet according to claim 1, wherein the protective insert comprises:

a peripheral portion at least partially complementarily shaped to the side wall of the housing cavity of the base element;

a base portion arranged to rest on or to lie near the bottom of the housing cavity of the base element; and a head portion arranged on the opposite side to the base portion arranged to rest against or to lie near the concave inner surface of the structure of the helmet.

4. The helmet according to claim 3, wherein the protective insert has a perforated structure provided with a dividing partition.

5. The helmet according to claim 1, wherein the first density value of the material of the base element is between 70 g/l and 110 g/l.

6. The helmet according to claim 1, wherein the second density value of the material of the protective insert is between 20 g/l and 40 g/l.

7. The helmet according to claim 1, further comprising a coupling mechanism operatively interposed between the structure and the protective body to ensure a removable engagement of the protective body with the structure of the helmet, the coupling mechanism comprising:

a coupling seat made on the protective body;

a coupling element arranged on the structure of the helmet, the coupling element engaging the coupling seat so that the protective body is positioned at at least two different positions with respect to the structure of the helmet.

8. The helmet according to claim 7, wherein the coupling seat and the coupling element of the coupling mechanism are configured so as to allow adjustment, in height, of the protective body with respect to the structure of the helmet.

9. The helmet according to claim 7, wherein the coupling seat comprises:

a cavity in the protective body; and a fixing button inside a cavity of the coupling seat and fixed to the cavity of the coupling seat to form a latching slot, the fixing button at least partly elastically deformable upon engagement with the coupling element of the coupling mechanism.

10. The helmet according to claim 9, wherein the coupling element comprises an engagement pin provided with two or more surface projections, each surface projection of the engagement pin determining a relative position between the protective body and the structure.

11. The helmet according to claim 9, wherein the cavity of the coupling seat is on the base element of the protective body, the cavity of the coupling seat facing toward the same side as the housing cavity of the base element.

12. The helmet according to claim 7, wherein the coupling seat is a first coupling seat and the coupling mechanism comprises a second coupling seat such that the first and second coupling seats align along a longitudinal axis of the protective body, the first coupling seat being disposed in a front portion of the protective body, the second coupling seat being arranged in a rear portion of the protective body.

13. The helmet according to claim 7, wherein the coupling seat of the coupling mechanism is formed near the housing cavity of the base element.

* * * * *